US008573894B2

(12) United States Patent
Freitag et al.

(10) Patent No.: US 8,573,894 B2
(45) Date of Patent: Nov. 5, 2013

(54) CONNECTION DEVICE FOR A REINFORCED EARTH STRUCTURE AND RELATED STRUCTURE AND METHOD

(75) Inventors: Nicolas Freitag, Orsay (FR); Jean-Claude Morizot, Paris (FR); Gilles Berard, Nogent sur Marne (FR)

(73) Assignee: Terre Armee Internationale, Velizy Villacoublay (FR)

( * ) Notice: Subject to any disclaimer, the term of this patent is extended or adjusted under 35 U.S.C. 154(b) by 83 days.

(21) Appl. No.: 13/386,365

(22) PCT Filed: Jul. 15, 2010

(86) PCT No.: PCT/FR2010/051487

§ 371 (c)(1),
(2), (4) Date: Jan. 20, 2012

(87) PCT Pub. No.: WO2011/010048

PCT Pub. Date: Jan. 27, 2011

(65) Prior Publication Data

US 2012/0114431 A1 May 10, 2012

(30) Foreign Application Priority Data

Jul. 22, 2009 (FR) ..... 09 55114

(51) Int. Cl.
*E02D 3/02* (2006.01)

(52) U.S. Cl.
USPC ..... 405/302.4; 405/262; 405/284; 405/285; 405/286

(58) Field of Classification Search
USPC ..... 405/262, 284, 285, 286, 302.4
See application file for complete search history.

(56) References Cited

U.S. PATENT DOCUMENTS

| | | | | |
|---|---|---|---|---|
| 4,952,098 | A | 8/1990 | Grayson et al. | |
| 4,993,879 | A * | 2/1991 | Hilfiker | 405/262 |
| 5,797,706 | A | 8/1998 | Segrestin et al. | |
| 6,186,703 | B1 * | 2/2001 | Shaw | 405/262 |
| 6,793,436 | B1 * | 9/2004 | Ruel et al. | 403/316 |

FOREIGN PATENT DOCUMENTS

| | | |
|---|---|---|
| EP | 0872597 | 10/1998 |
| FR | 2803610 | 7/2001 |

* cited by examiner

*Primary Examiner* — Frederick L Lagman
*Assistant Examiner* — Carib Oquendo
(74) *Attorney, Agent, or Firm* — McKenna Long & Aldridge LLP

(57) ABSTRACT

Link device (100) between a facing element (20) of a reinforced ground construction work (1) and a longitudinal reinforcement (40), intended to extend in a backfill (60), which comprises a portion (101) for fixing to the facing element (20), two connecting portions (102), of which a first end of each of them is linked to a point of the fixing portion (101), in which a second end of each connecting portion is linked to a first end of a first and of a second return portion (103), in which the return portions (103) are substantially parallel to one another and in which a second end of each of the return portions is linked to a securing segment (104) substantially perpendicular to the return portions (103).

15 Claims, 10 Drawing Sheets

CONNECTION DEVICE FOR A REINFORCED EARTH STRUCTURE AND RELATED STRUCTURE AND METHOD

This application is a National Stage Entry of International Application No. PCT/FR2010/051487, filed on Jul. 15, 2010, and claims the benefit of France Patent Application No. 09 55114, filed on Jul. 22, 2009, both of which are hereby incorporated by reference for all purposes in their entirety.

BACKGROUND OF THE INVENTION

The present invention relates to a link device for the construction of reinforced ground works. This construction technique is commonly used to produce works such as support walls, bridge abutments, etc.

A reinforced ground work combines a compacted backfill, a facing and reinforcements, usually connected to the facing. The facing generally consists of a plurality of facing elements assembled together.

Various types of reinforcements, generally longitudinal, can be used: metal (for example comprising rods made of galvanized steel), synthetic materials (for example based on polyester fibers or geotextiles). They are put in place in the ground with a density dependant on the stresses that may be exerted on the work, the thrust forces of the terrain being taken up by the ground-reinforcement friction.

The facing is most often made from prefabricated concrete elements, or metal mesh in the form of panels that are juxtaposed to cover the front face of the work.

There may be horizontal setbacks on the front face between different facing levels. The front face may also be inclined, generally with an initial ground surface area greater than at the top of the reinforced ground work, but it is also possible to create works with overhanging facings.

The reinforcements placed in the backfill are joined to the facing using link devices that can take various forms. Once the work is finished, the reinforcements distributed in the backfill transmit high loads, that can range up to several tons.

The known link devices are, for example, devices comprising a portion fixed to a facing element extended by portions comprising means for receiving a pin around which a reinforcement may be arranged. One example of such an embodiment emerges from the document FR 2 803 610.

According to another example, illustrated in the document EP 0 872 597, the link devices comprise hook-shaped portions fixed to a facing element and linked by a return portion around which is arranged a tube, around which a reinforcement may be arranged.

These known link devices however present certain drawbacks because their installation may entail a number of steps and in some cases it is found that the link between a reinforcement and the facing may not be optimal.

An object of the present invention is to overcome the abovementioned drawbacks and offer a link device, for a reinforced ground work that is economical, simple to implement and provides a good link between a facing element and a longitudinal reinforcement.

SUMMARY OF THE INVENTION

The invention thus proposes a link device between a facing element of a reinforced ground construction work and a longitudinal reinforcement, intended to extend in a backfill of said work, in which said link device comprises a portion for fixing to the facing element, two connecting portions of which a first end of each of them is linked to a point of the fixing portion, in which a second end of each connecting portion is linked to a first end of a first and of a second return portion, in which the return portions are substantially parallel to one another and in which a second end of each of the return portions is linked to a securing segment substantially perpendicular to the return portions.

The facing elements may be of different types, such as, and in a nonlimiting manner, formed by metal meshes, slabs of cement or concrete, notably reinforced, panels made of plastic, panels made of wood, for example in the form of duckboards, gratings obtained using geomaterials, called geogratings. These facing elements generally arranged to constitute the front face of the work may be arranged substantially vertically, or inclined backward or forward, overhanging.

According to one embodiment, the longitudinal reinforcement consists of a flexible strip.

The expression "fixing portion" should be understood to mean a portion of the link device which is intended to be joined with the facing element. Such a join may be made for example by fixing the link device in an appropriate portion of a completed facing element, notably to a rod of the facing element or to a ring joined to the facing element, or may be made at the time of manufacture of the facing element, notably by insertion in a mould of the link device at the time when a facing element is poured, or also by deformation of metal rods of the facing element to form the link device.

The expression "return portion" should be understood to mean a portion of the link device which is intended to receive a longitudinal reinforcement, notably a flexible reinforcement. In the latter case, the flexible reinforcement is preferably arranged in such a way as to form an open loop around the return portion. This open loop is then extended by two reinforcing portions of the strip extending into the backfill.

The expression "securing segment" should be understood to mean a portion of the link device, extending the end of a return portion, away from the end linked to a fixing portion, and arranged in a direction other than that of said return portion.

The expression "substantially parallel" should be understood to mean the relative arrangement of two portions, in which the angle that is made by one relative to the other is small, for example less than or equal to 10°.

The expression "substantially perpendicular" should be understood to mean the relative arrangement of two portions for which the angle that one makes relative to the other is close to right angle, for example equal to 90°± to 10°.

The link device according to the invention has a structure that is simple and economic to produce.

It can, for example, be obtained by bending and/or welding a metal rod or a plurality of metal rods, notably made of steel.

According to one embodiment, the various portions forming the link device are materially continuous.

The inventors have been able to confirm that the presence of a securing segment substantially perpendicular to each return portion makes it possible to avoid having the link device open significantly when a traction force is applied by a longitudinal reinforcement linked to a facing element by said link device.

There are thus obtained, by virtue of the link device according to the invention, lasting construction works, in which the reinforcement and the facing element are linked together in an effective and simple manner.

According to various embodiments of the link device, which may be combined together in all possible configurations:

the two securing segments are arranged in a plane substantially perpendicular to the median plane formed by the fixing portion, the two connecting portions and the two return portions; the expression "median plane" should be understood to mean a plane in which the projected area of the link device is maximal, and passing equidistantly from each of the return portions (either between the two return portions, or through them);

the two securing segments are arranged in opposite directions perpendicular to the return portions;

the link device forms a continuous open loop in which the two return portions are spaced apart from one another by a substantially constant distance; as an example, the distance between the two return portions is between 1 cm and 5 cm;

the fixing portion is substantially C-shaped with a radius of curvature of between 1 cm and 10 cm;

the two connecting portions form a V or a U with the fixing portion.

According to one embodiment, the link device forms part of a metal grating panel consisting of a plurality of metal rods welded together in which the ends of two substantially parallel metal rods are bent so that each forms a connecting portion, a return portion and a securing segment.

The invention also targets a method for constructing a reinforced ground construction work comprising a facing erected along a front face of the work, a backfill, situated behind said facing and longitudinal reinforcements extending in the backfill and linked to the facing by a link device according to the invention and described hereinabove.

According to various embodiments of the reinforced ground construction work, which may be combined together in all possible configurations:

the longitudinal reinforcements are flexible strips which form an open loop around the two return portions of the link device;

a loop-shaped bearing piece is arranged around the two return portions of the link device and the open loop formed by the flexible strips passes around this bearing piece;

the link device forms a continuous open loop in which two portions are spaced apart from one another by a substantially constant distance, the facing element is a metal grating panel consisting of a plurality of metal rods welded together and the link device is arranged at the intersection of two welded metal rods.

According to one embodiment, the width of a return portion is of the same order of magnitude as that of the reinforcement that is linked to it, and is even substantially equal.

According to one embodiment, the facing element is a concrete element into which the fixing portion of a link device is inserted, notably during manufacture by pouring of said concrete element, and the two connecting portions emerge from the concrete element and are extended beyond by the two return portions and the two securing segments.

The invention also relates to a method for constructing a work, as defined hereinabove, wherein facing elements are erected along a front face of the work, backfill material is added behind said facing elements after having put in place longitudinal reinforcements, the backfill material is compacted, and longitudinal reinforcements are linked to the facing elements by a link device according to the invention and described hereinabove.

According to an embodiment in which the link device forms a continuous open loop in which two return portions are spaced apart from one another by a substantially constant distance, said link device is introduced at the intersection of the two welded metal rods by passage between the two return portions.

BRIEF DESCRIPTION OF THE DRAWINGS

Other features and advantages of the present invention will become apparent in the following description of nonlimiting exemplary embodiments, with reference to the appended drawings, in which.

DECRIPTION OF THE EMBODIMENTS

In the interests of clarity, the dimensions of the various elements represented in these figures are not necessarily in proportion to their true dimensions. In these figures, identical references correspond to identical elements.

Figure 1A:
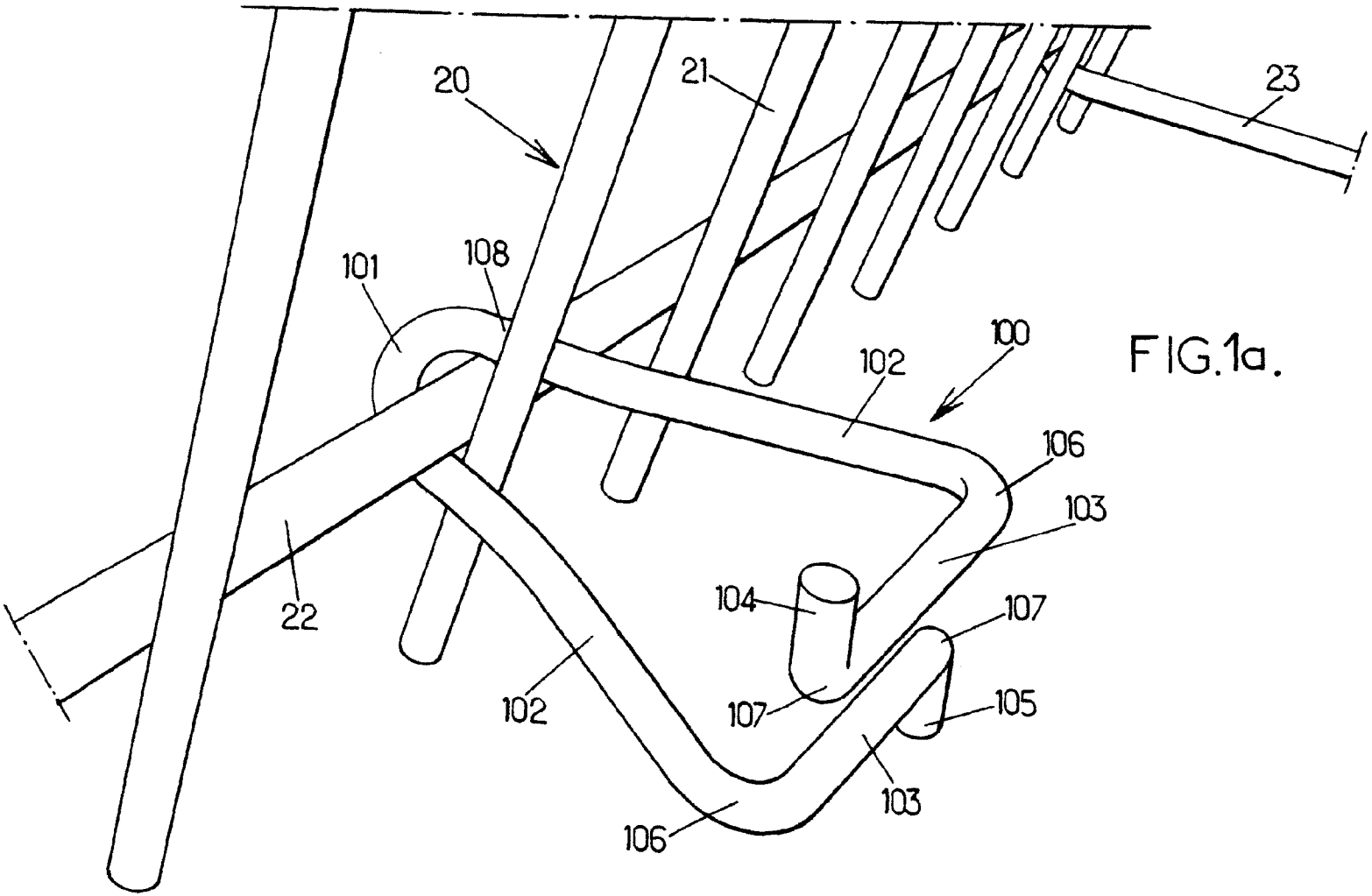
FIGS. 1*a* and *b* to 5 are perspective diagrammatic views of link devices according to the invention fixed at the intersection of two metal rods of a grating forming a facing element.
Figure 1B:
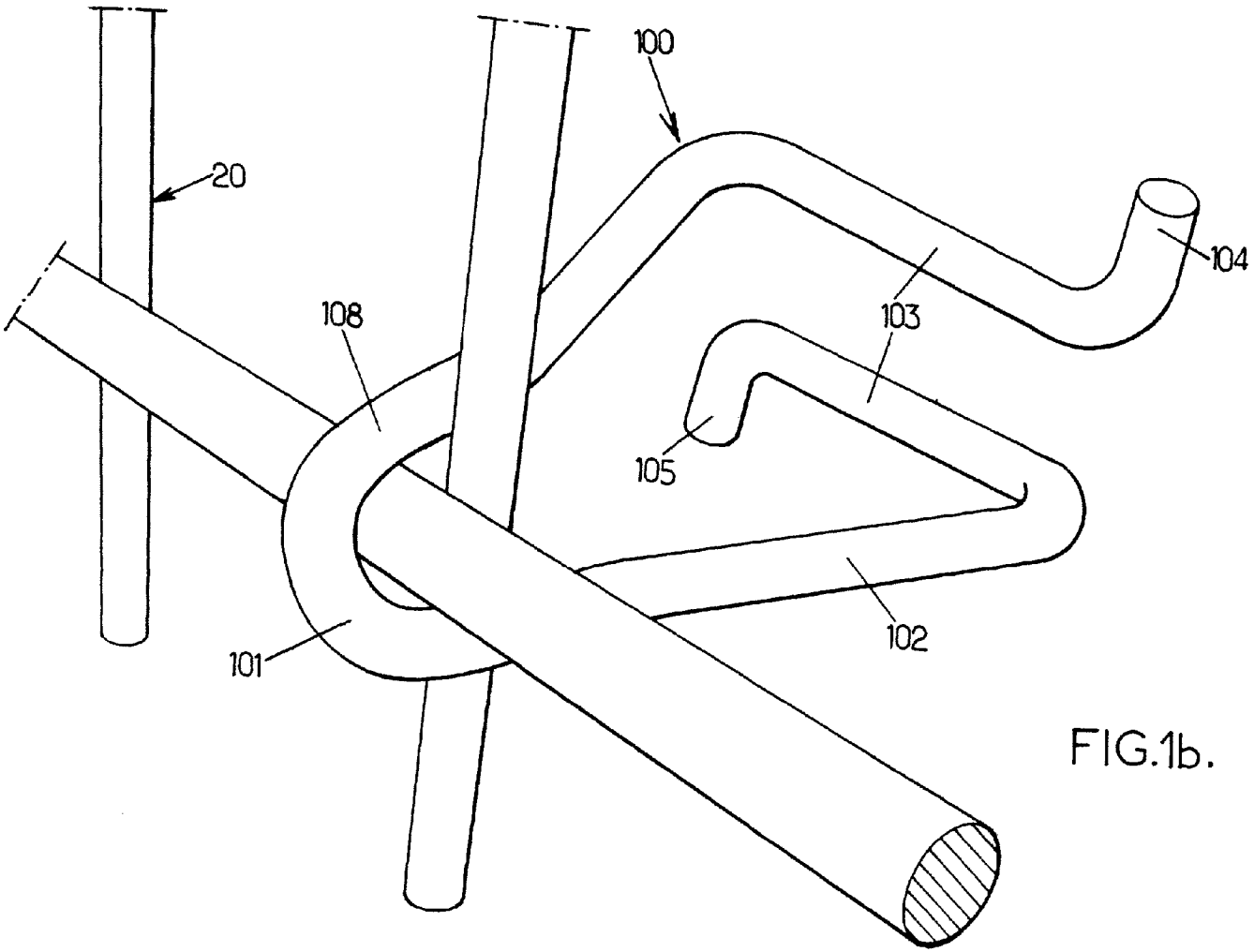

FIGS. 1*a* and *b* illustrate a link device 100 according to the invention, fixed to a facing element 20, consisting of metal rods 21 intended to be arranged horizontally, and 22 intended to be arranged substantially vertically, welded together. A metal rod 23 comprising a portion intended to be arranged horizontally and a folded portion intended to support the assembled rods 20 and 21 (see also FIGS. 7 and 8).

Such an arrangement of facing elements intended for the construction of a reinforced ground work is, for example, implemented in the products with the trade name TerraTrel® marketed by the company Terre Armee Internationale.

The link device 100 consists of a bent metal rod which comprises a number of portions: a C-shaped fixing portion 101 extended by two straight sections 108, two connecting portions 102 separating the straight sections 108, two return portions 103 linked to the connecting portions 102 by a bend 106 and two securing segments 104, 105 each linked to the return portions 103 by a bend 107. The whole forms an open loop in which the two return portions are parallel, spaced apart by a substantially constant distance. The two securing segments 104, 105 are arranged in opposite directions, perpendicularly to the return portions, in a plane perpendicular to the median plane formed by the fixing portion, the two connecting portions and the two return portions.

There may, for example, be a flexible strip forming a loop around the return portions 103. Tests have shown that a strip arranged in this way and kept under tension would not lead to significant deformations of the loop device 100. It is found that, in the same conditions, a link device without securing segments tends to open and that, after a certain time, the strip may slip out of the link device and become detached therefrom.

Figure 2:
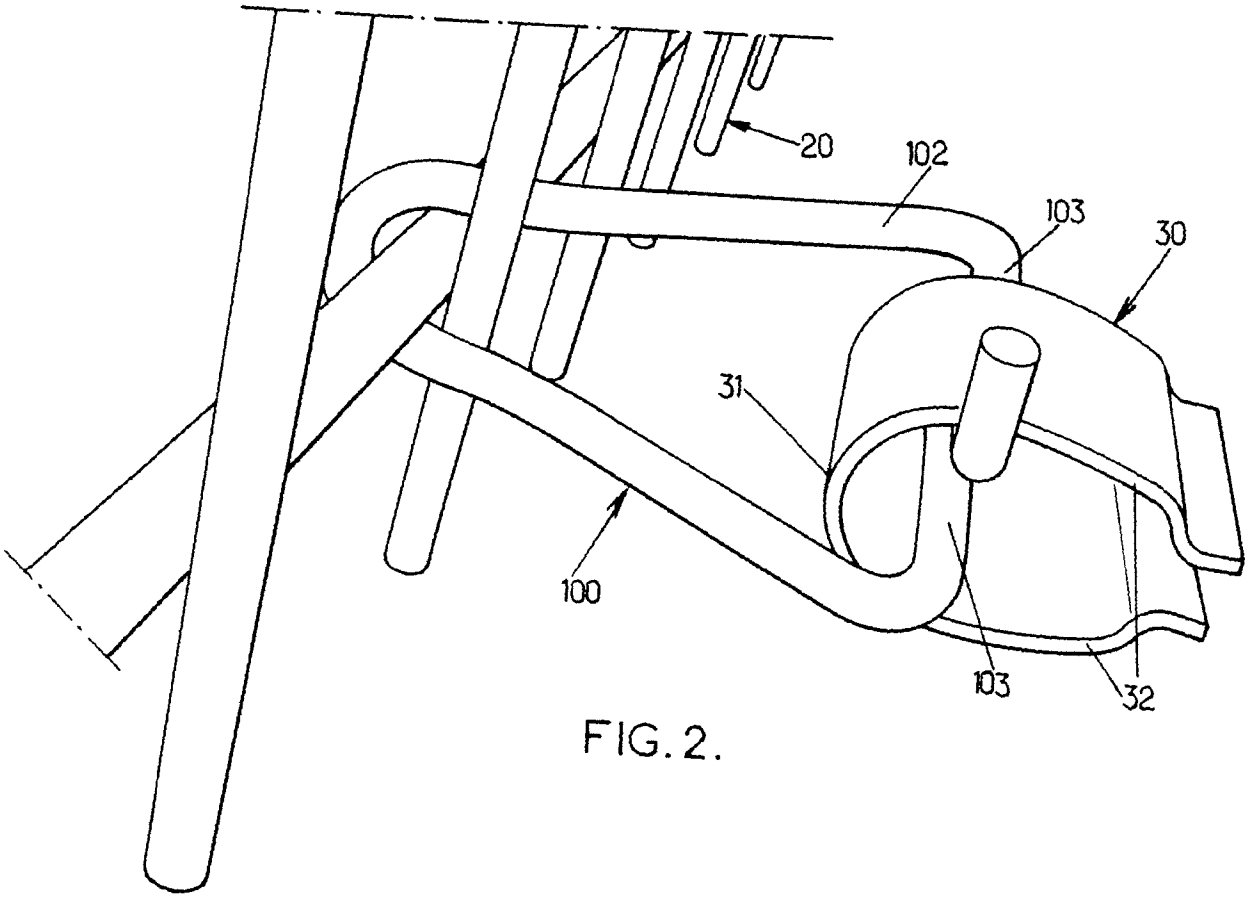

FIG. 2 shows the link device of FIGS. 1*a* and *b* in which the return portions 103 are surrounded by a bearing piece 30. This bearing piece makes it possible to impose a desired curvature on the flexible strip arranged to form an open loop around it. It is thus possible to limit the risks of damaging such a strip. The bearing piece comprises a C-shaped portion 31 extended by two wings 32 on which a flexible strip may rest.

Figure 3:
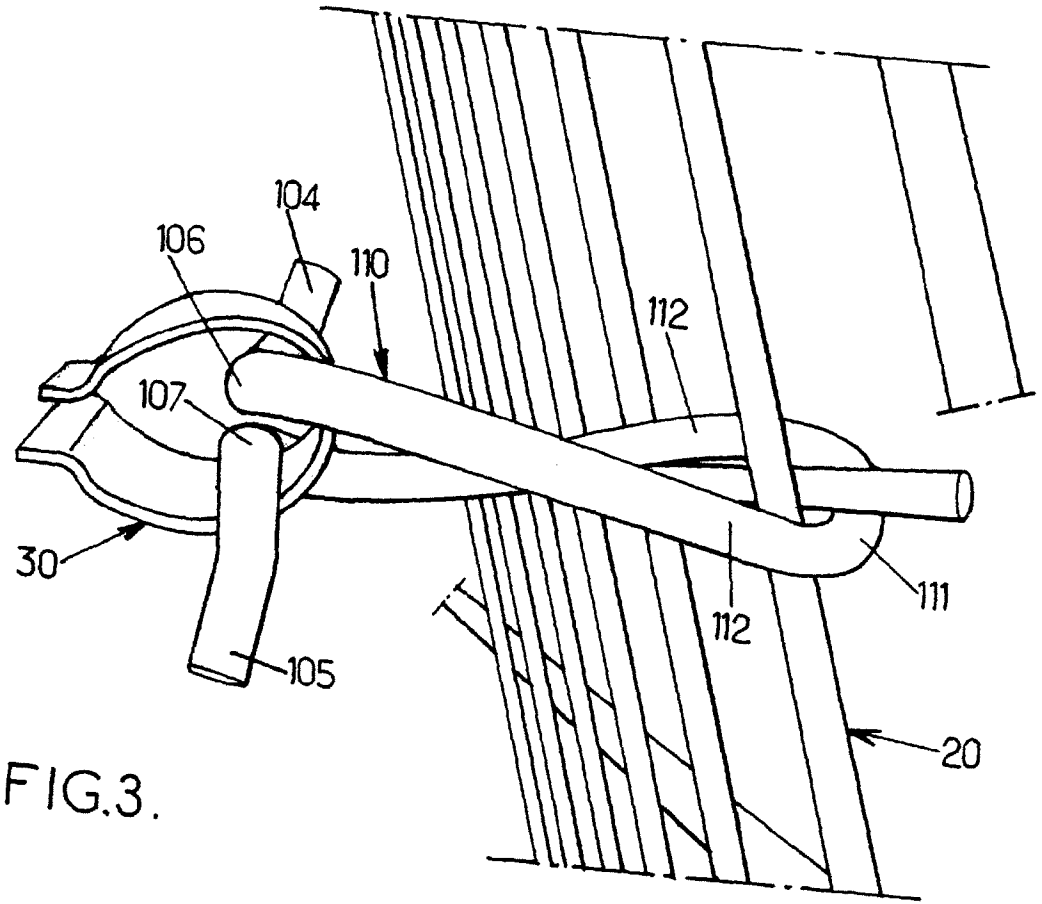

FIG. 3 shows a variant 110 of the preceding link device in which the fixing portion 111 and the connecting portions 112 form a continuous curve.

Figure 4:
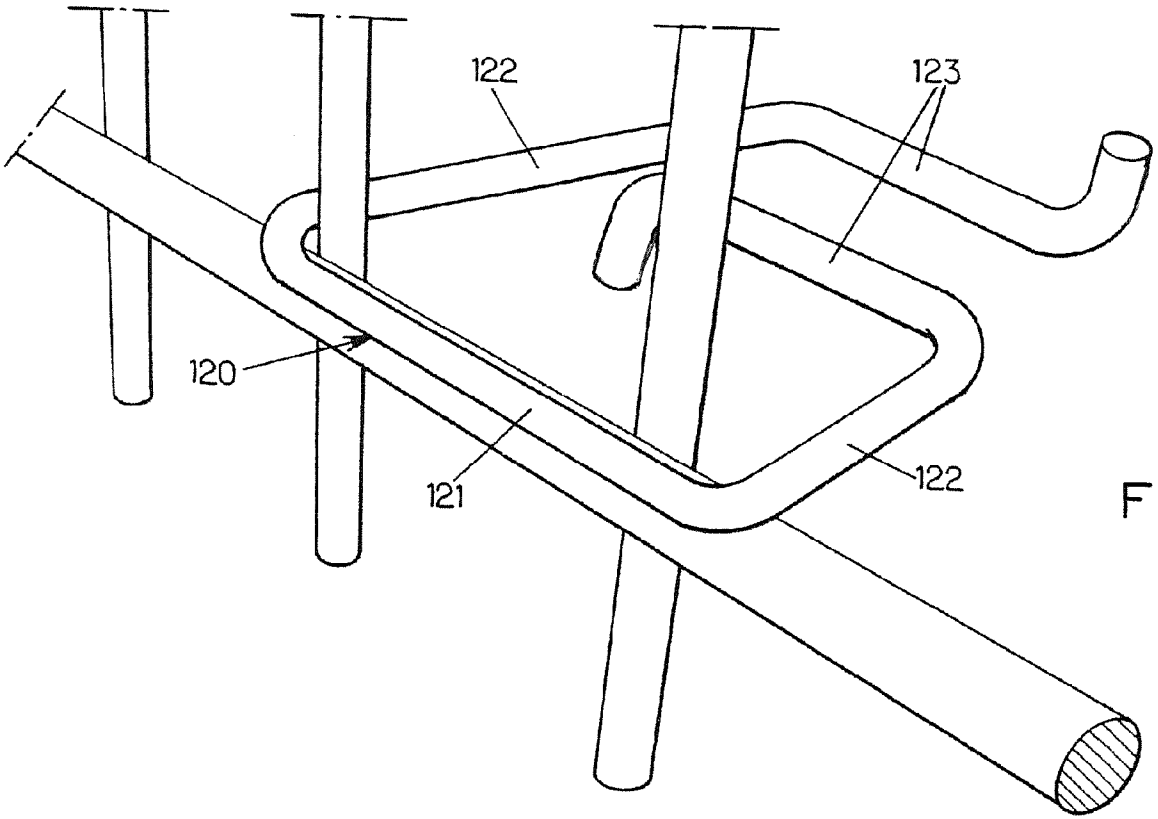

FIG. 4 illustrates another variant 120 of a link device in which the maximum dimension of the fixing portion 121 is such that it can be arranged around at least two consecutive vertical bars of the metal grating panel. In this embodiment, the connecting portions 122 may be substantially parallel to one another, or be convergent towards return portions 123, the size of which is less than the maximum dimension of the fixing portion 121.

Figure 5:
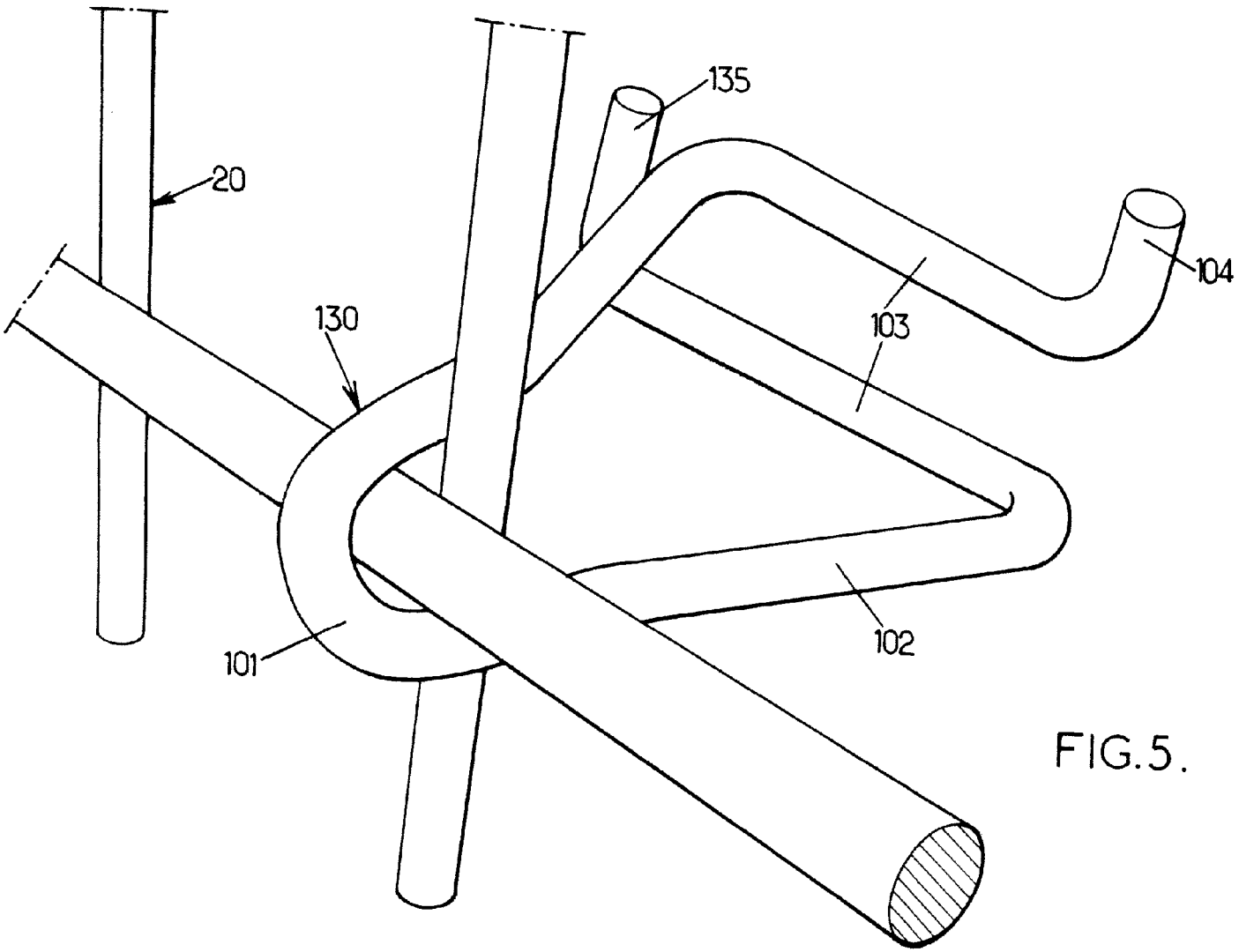
Figure 6:
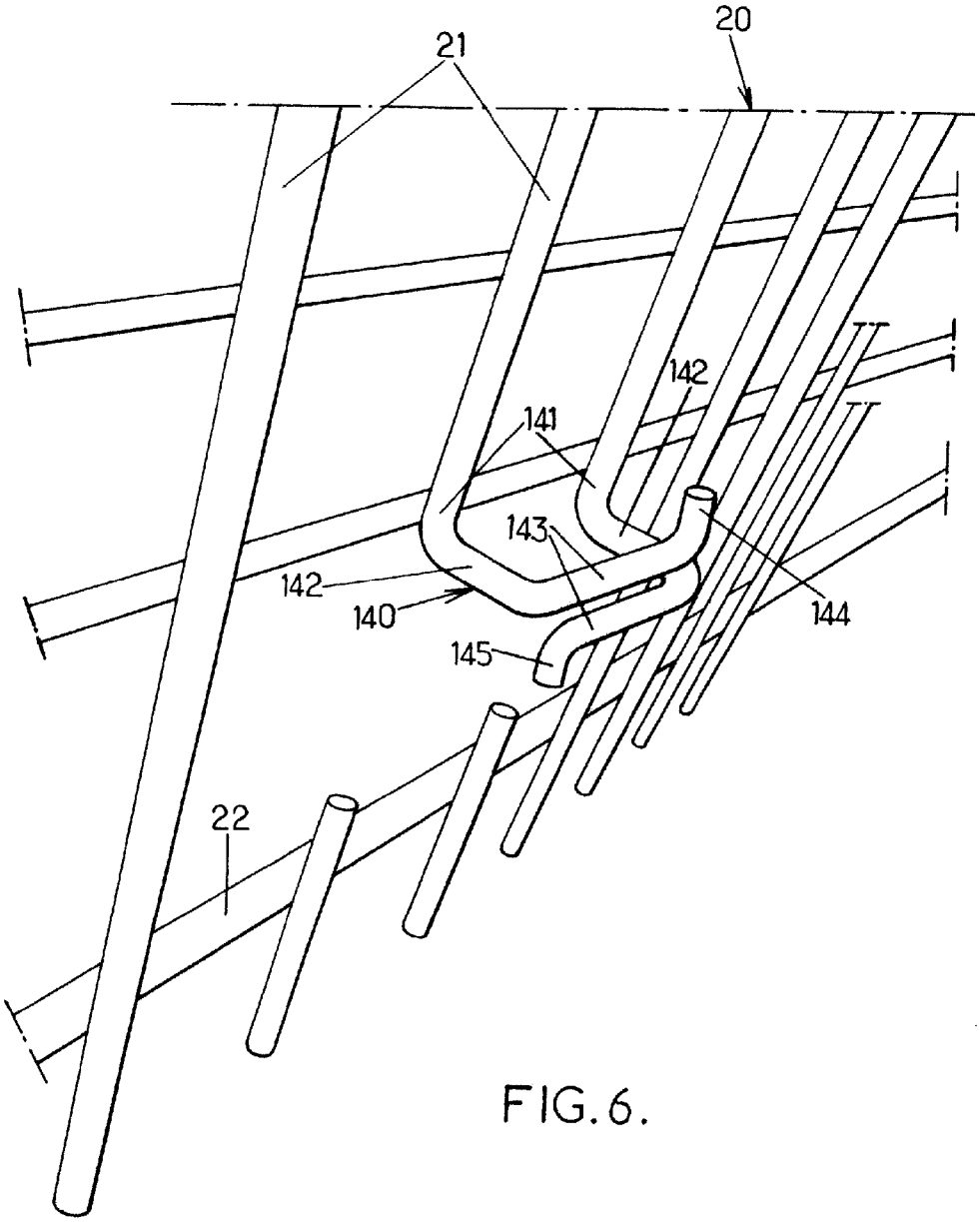
FIG. 6 is a perspective diagrammatic view in which the metal rods of a facing element-forming grating are bent to form a link device according to the invention.

FIG. 5 illustrates a variant 130 of the fixing device of FIGS. 1*a* and 6 in which the two securing segments 104 and 135 are arranged in the same direction.

It is found that the fixing devices of FIGS. 1 to 5 can easily be arranged around one or more metal rods of the metal grating panel. It is possible, in fact, to slide these fixing devices through the opening provided by the space between the two return portions.

According to the embodiment represented in FIGS. 1 to 3 and 5, the fixing portion is arranged at an angle, substantially at 45° relative to the welded vertical and horizontal rods. It is thus possible to arrange these fixing devices at a particularly strong point of the metal grating panel.

According to the embodiment represented in FIG. 4, the fixing device is slipped so that it surrounds two rods, thus make it possible to distribute the traction force over the panel when the work is completed.

FIG. 6 illustrates an embodiment of a fixing device in which the latter is obtained by bending and/or welding welded metal rods 1 of the facing element-forming metal grating 20. The fixing portion 141 consists of the link region between two vertical rods 21 and a horizontal rod 22 and is extended by two connecting portions 142, which are in turn extended by two return portions 143 linked to two securing segments 144, 145, arranged perpendicularly to the return portions 143.

Figure 7:
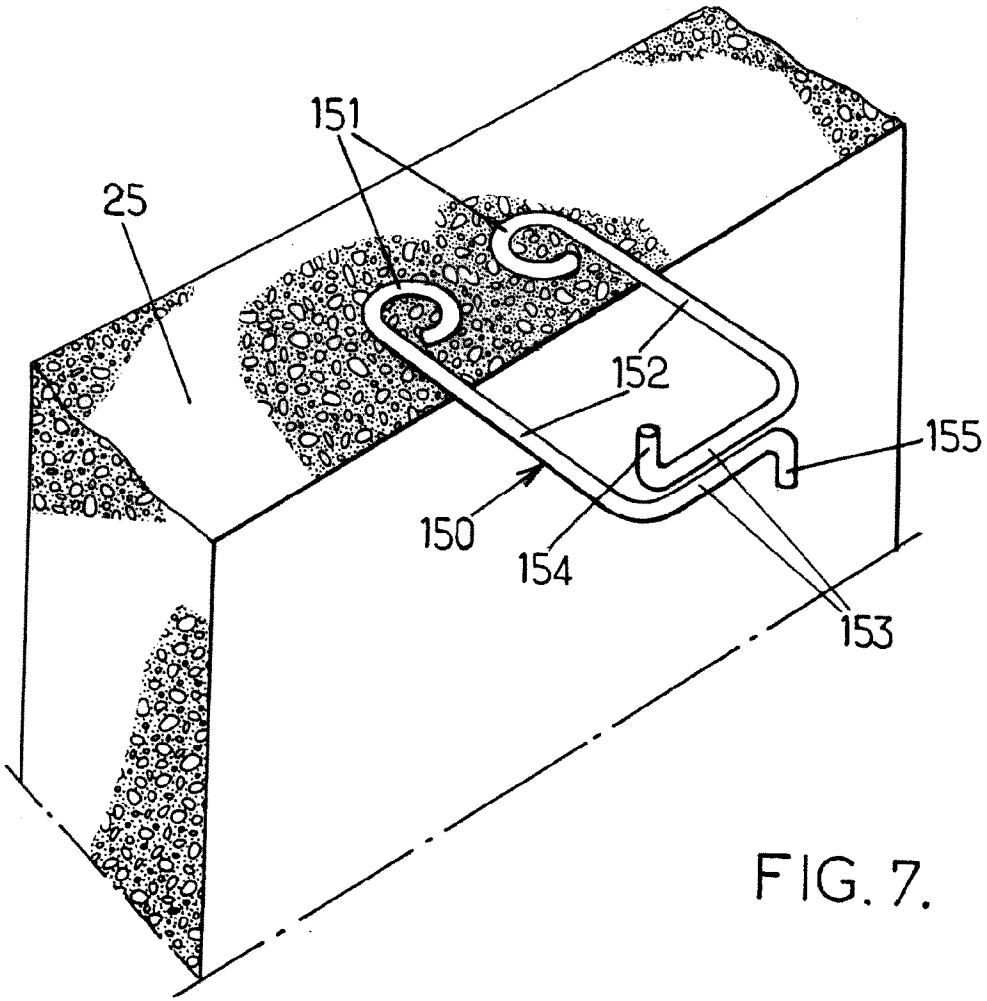
FIG. 7 is a perspective diagrammatic view in which a link device is embedded in a facing element made of concrete to form a work according to the invention.

FIG. 7 illustrates another embodiment in which the fixing device 150 consists of two bent metal rods each comprising a fixing portion 151, extended by a connecting portion 152, which is in turn extended by a return portion 153 linked to a securing segment 154 or 155. The fixing portions 151 are hook shaped and are fixed together and with the desired spacing in the concrete facing element 25 when the concrete is poured into a mould. It is then possible to arrange a flexible strip around the return portions 153 without the latter running the risk of becoming significantly separated from one another when the work is loaded.

Figure 8:
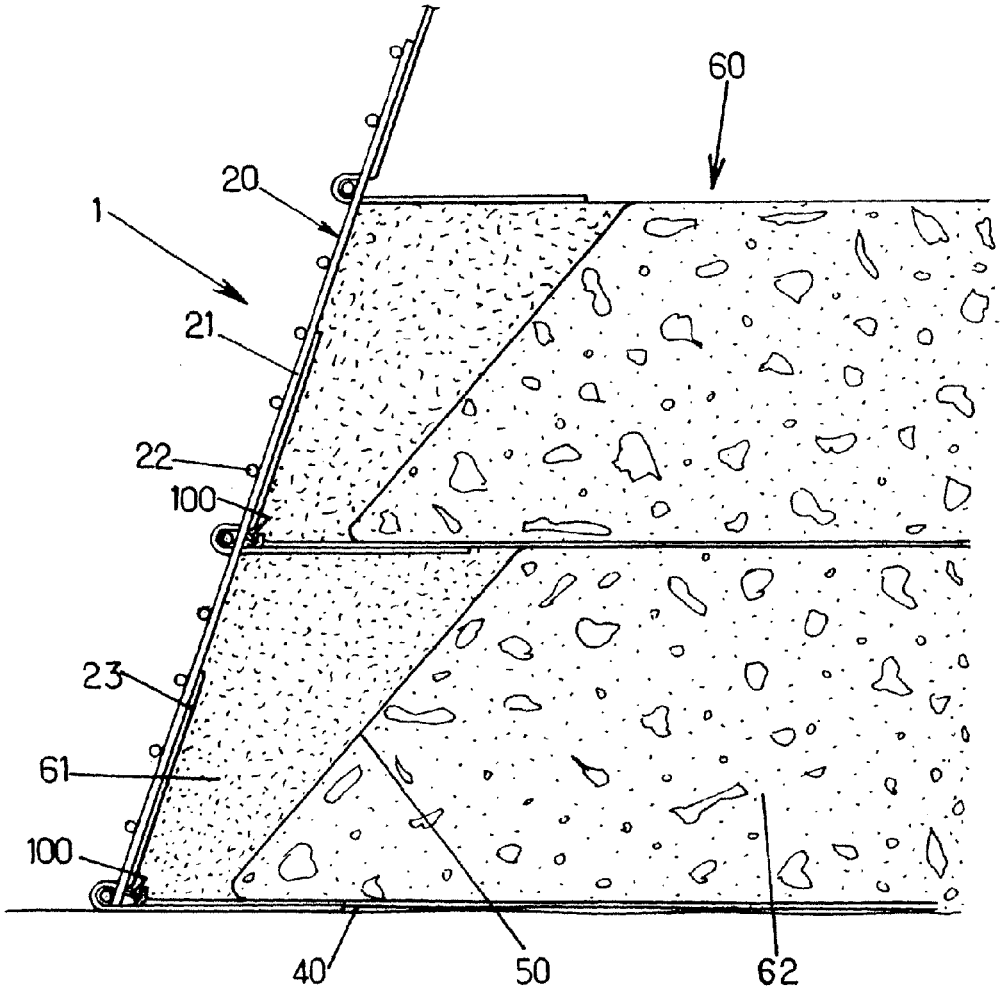
FIGS. 8 and 9 illustrate diagrammatic cross sections of works according to the invention.
Figure 9:
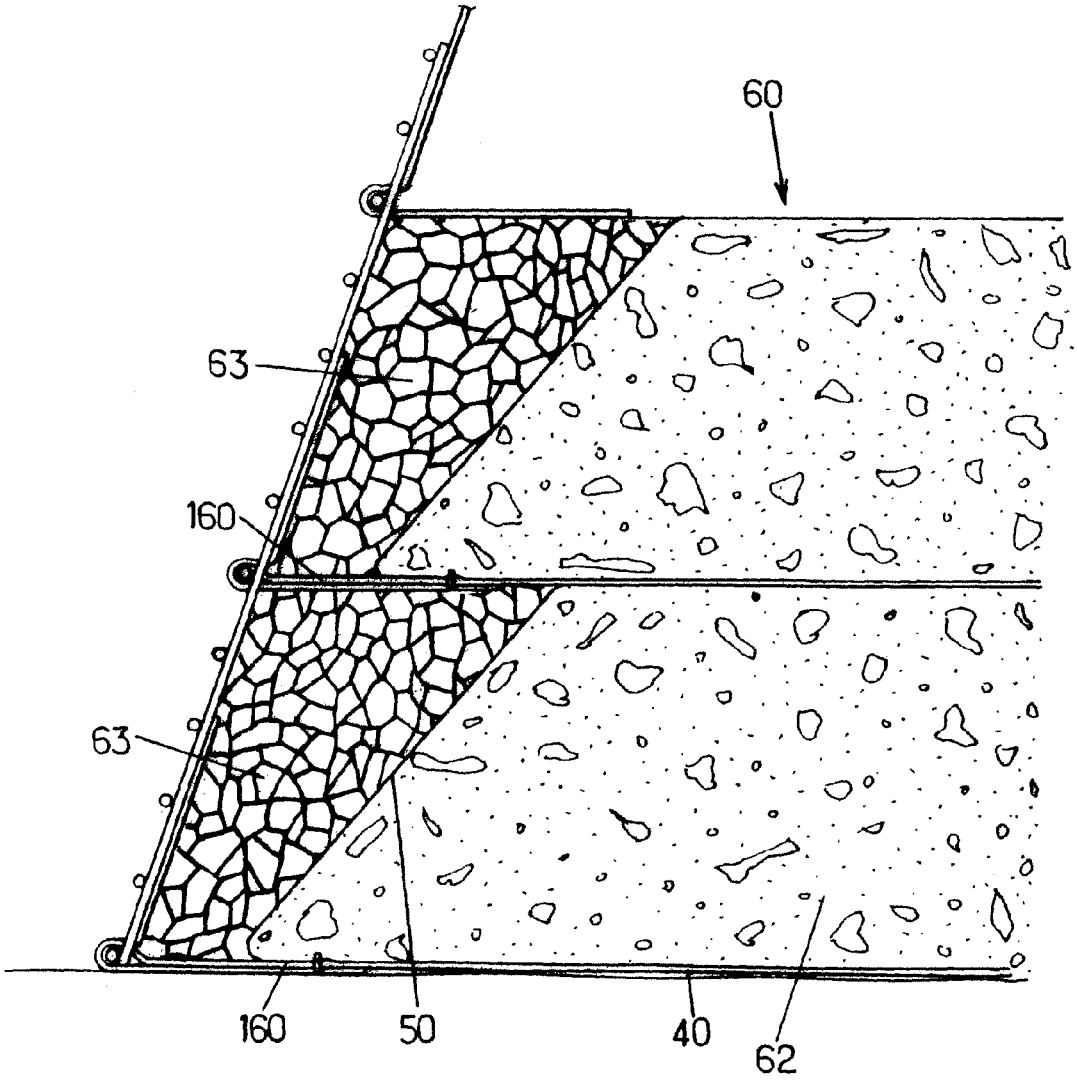

FIGS. 8 and 9 illustrate diagrammatic cross sections of works according to the invention. The general structure of such a work corresponds to the works known by the trade name TerraTrel® marketed by the company Terre Armee Internationale.

The work 1 comprises a facing consisting of a plurality of facing elements 20 arranged one on top of the other. The facing elements 20 are gratings consisting of horizontal 22 and perpendicular 22 metal rods, welded together. Bent rods 23 are arranged in such a way as to contribute to the stability of the facing, with a portion in the horizontal plane and a portion along the inclination of the facing.

Behind the facing, there is a backfill 60. This backfill may consist of various materials, such as compacted earth 61, a mixture of earth and pebbles 62, pebbles or rock fragments 63. According to certain embodiments, the backfill consists of a number of types of backfill materials. These different types of backfill materials may be separated by a film, a fabric, notably by a geomaterial fabric 50. It is thus possible to obtain works whose appearance differs significantly and is selected according to the desired aesthetic: according to FIG. 8, it is possible to have a layer of arable earth 61 in contact with the facing, which may then be covered with plants; according to FIG. 9, rock fragments that remain visible may be arranged in contact with the facing.

The work is reinforced by flexible strips 40 which extend in the facing. These flexible strips may be arranged in a horizontal plane, perpendicularly or in a zigzag relative to the facing.

They may also be attached to a wall situated behind the facing and in which the space between this wall and the facing is filled by the backfill.

The strips 40 form a loop around the two return portions of link devices according to the invention 100 (FIG. 8), 160 (FIG. 9).

In the case of FIG. 8, the link devices are small, typically with a length of around 10 to 20 cm and are of the type of those represented in FIGS. 1 to 5.

In the case of FIG. 9, there may be an advantage in displacing the return portions of the link devices towards the rear of the facing. In practice, it may be advantageous to avoid arranging flexible strips 40 in the region 63 in which the backfill is made of rock fragments in order to avoid damaging these strips. To do this, the connecting portions of the link devices of the type of those represented in FIGS. 1 to 5 may be extended, to obtain link devices 160 represented in FIG. 9, the length of which may be of the order of a meter. It is also possible to arrange an intermediate connecting piece between the link devices and the reinforcing strips, for example by arranging a closed loop of a strip of flexible material around the return portions of the link devices and by linking the other end of the loop to a reinforcing strip.

Moreover, it will be noted that the link device may also be linked to the facing via a piece, such as, for example, a ring, a flexible loop, hooks, or any other piece into which the fixing portion of the link device can be inserted.

The invention is not limited to these types of embodiment and should be interpreted in a nonlimiting manner, encompassing any equivalent embodiment.

The proposed link device can link any type of facing of a reinforced ground work with any type of longitudinal reinforcement likely to reinforce said work.

The invention claimed is:

1. A link device for mounting between a facing element of a reinforced ground construction work and a longitudinal reinforcement, intended to extend in a backfill of said work, wherein said link device comprises:

a portion for fixing to the facing element;

two connecting portions each having a first end linked to a point of the fixing portion and a second end; and first and second return portions substantially parallel to one another, each of the return portions having a first end linked to the second end of a respective connecting portion and a second end linked to a securing segment substantially perpendicular to the return portions.

2. The link device of claim 1, made of one or more bent and/or welded metal rod(s).

3. The link device of claim 1, wherein the two securing segments are arranged in a plane substantially perpendicular to a median plane formed by the fixing portion, the two connecting portions and the two return portions.

4. The link device of claim 1, wherein the two securing segments are arranged in opposite directions perpendicular to the return portions.

5. The link device of claim 1, formed as a continuous open loop, the two return portions being spaced apart from one another by a substantially constant distance.

6. The link device of claim 1, wherein the fixing portion is substantially C-shaped with a radius of curvature of between 1 cm and 10 cm.

7. The link device of claim 1, wherein that the two connecting portions form a V or a U with the fixing portion.

8. The link device of claim 1, forming part of a metal grating panel consisting of a plurality of metal rods welded together, the ends of two substantially parallel metal rods being bent so that each forms connecting portions, return portions, and securing segments.

9. A reinforced ground construction work comprising a facing erected along a front face of the work, a backfill, situated behind said facing and longitudinal reinforcements extending in the backfill and linked to the facing by a link device, wherein the link device comprises:

a portion for fixing to the facing element;

two connecting portions each having a first end linked to a point of the fixing portion and a second end;

first and second return portions substantially parallel to one another, each of the return portions having a first end linked to the second end of a respective connecting portion and a second end linked to a securing segment substantially perpendicular to the return portions.

10. The construction work of claim 9, wherein the longitudinal reinforcements are flexible strips each forming an open loop around the two return portions of the link device.

11. The construction work of claim 10, wherein a loop-shaped bearing piece is arranged around the two return portions of the link device and wherein the open loop formed by the flexible strips passes around said bearing piece.

12. The construction work of claim 9, wherein the link device is formed as a continuous open loop, the two return portions being spaced apart from one another by a substantially constant distance, wherein the facing element comprises a metal grating panel consisting of a plurality of metal rods welded together and wherein said link device is arranged at an intersection of two welded metal rods.

13. The construction work of claim 9, wherein the facing element is a concrete element in which the fixing portion of the link device is inserted, and wherein the two connecting portions emerge from the concrete element and are extended beyond by the two return portions and the two securing segments.

14. A method of building a construction work, comprising:

erecting facing elements along a front face of the work;

putting in place longitudinal reinforcements;

linking the longitudinal reinforcements to the facing elements by a link device;

adding backfill material behind said facing elements; and compacting the backfill material, wherein the link device comprises:

a portion for fixing to the facing element;

two connecting portions each having a first end linked to a point of the fixing portion and a second end;

first and second return portions substantially parallel to one another, each of the return portions having a first end linked to the second end of a respective connecting portion and a second end linked to a securing segment substantially perpendicular to the return portions.

15. The method of claim 14, wherein the link device is formed as a continuous open loop, the two return portions being spaced apart from one another by a substantially constant distance wherein the facing element comprises a metal grating panel consisting of a plurality of metal rods welded together, wherein said link device is arranged at an intersection of two welded metal rods, and wherein the link device is introduced at the intersection of the two welded metal rods by passage between the two return portions.

* * * * *